US009255453B1

(12) United States Patent
Jennings

(10) Patent No.: US 9,255,453 B1
(45) Date of Patent: Feb. 9, 2016

(54) HEAVY DUTY RISER CONNECTOR ASSEMBLY

(71) Applicant: Phyllis A. Jennings, Tomball, TX (US)

(72) Inventor: Charles E. Jennings, Tomball, TX (US)

(73) Assignee: Phyllis A. Jennings, Tomball, TX (US)

( * ) Notice: Subject to any disclaimer, the term of this patent is extended or adjusted under 35 U.S.C. 154(b) by 0 days.

(21) Appl. No.: 14/608,144

(22) Filed: Jan. 28, 2015

Related U.S. Application Data

(60) Provisional application No. 61/965,469, filed on Jan. 31, 2014.

(51) Int. Cl.

| | |
|---|---|
| ***E21B 17/01*** | (2006.01) |
| ***E21B 17/08*** | (2006.01) |
| ***E21B 17/046*** | (2006.01) |
| ***E21B 17/06*** | (2006.01) |

(52) U.S. Cl.
CPC ..... *E21B 17/085* (2013.01); *E21B 17/01* (2013.01); *E21B 17/046* (2013.01); *E21B 17/06* (2013.01)

(58) Field of Classification Search
CPC ..... E21B 17/01; E21B 17/085
USPC ..... 166/345, 367; 285/374, 376
See application file for complete search history.

(56) References Cited

U.S. PATENT DOCUMENTS

| | | | | |
|---|---|---|---|---|
| 3,628,812 | A * | 12/1971 | Larralde et al. | 285/24 |
| 4,093,281 | A * | 6/1978 | Jansen, Jr. | 285/39 |
| 4,491,346 | A * | 1/1985 | Walker | E21B 33/038 285/18 |
| 4,557,508 | A * | 12/1985 | Walker | 285/84 |
| 4,693,497 | A * | 9/1987 | Pettus et al. | 285/12 |
| 4,817,992 | A * | 4/1989 | Yip et al. | 285/18 |
| 4,823,879 | A * | 4/1989 | Brammer et al. | 166/341 |
| 4,902,045 | A * | 2/1990 | McGugan et al. | 285/24 |
| 6,609,734 | B1 * | 8/2003 | Baugh | 285/322 |
| 6,824,171 | B2 * | 11/2004 | Milberger et al. | 285/123.13 |
| 7,686,087 | B2 * | 3/2010 | Pallini et al. | 166/367 |
| 7,686,342 | B2 * | 3/2010 | Jennings et al. | 285/39 |
| 8,479,824 | B2 * | 7/2013 | Travis et al. | 166/344 |
| 8,757,671 | B2 * | 6/2014 | Pallini et al. | 285/322 |
| 8,978,770 | B2 * | 3/2015 | DeBerry et al. | 166/344 |
| 2003/0141718 | A1 * | 7/2003 | Bilderbeek | 285/348 |
| 2005/0001427 | A1 * | 1/2005 | Liew | 285/322 |
| 2011/0227336 | A1 * | 9/2011 | Mogedal et al. | 285/314 |

* cited by examiner

*Primary Examiner* — Matthew R Buck
(74) *Attorney, Agent, or Firm* — Buskop Law Group, PC; Wendy Buskop

(57) ABSTRACT

A heavy duty riser connector assembly for joining together and sealing sections of pipe, having an upper connector housing, a lower connector housing and grooves and ribs formed circumferentially on an outer diameter each housing. The assembly having a locking sliding sleeve to slide over and lock together the connector housing and a locking detent ring adapted to pop out and lock the locking sliding sleeve in place so the permanent locking sliding sleeve is not effected by vibration when the locking sliding sleeve has been slid over at least one flexible collet. The assembly can simultaneously seal a riser bore against internal and external pressure while additionally carrying heavy tensile and bending loads without deforming while engaging a riser for both drilling and production or any other application requiring rapid makeup of pipe.

16 Claims, 7 Drawing Sheets

HEAVY DUTY RISER CONNECTOR ASSEMBLY

CROSS REFERENCE TO RELATED APPLICATIONS

The present application claims priority to and the benefit of U.S. Provisional Patent Application Ser. No. 61/965,469 filed on Jan. 31, 2014, entitled "Push to Connect and Lock Marine Riser System." This reference is hereby incorporated in its entirety.

FIELD

The present embodiments generally relate to a marine riser connection.

BACKGROUND

A need exists for a heavy duty marine riser connector assembly with higher reliability than commercially available systems.

The present embodiments meet these needs.

BRIEF DESCRIPTION OF THE DRAWINGS

The detailed description will be better understood in conjunction with the accompanying drawings as follows.

Figure 1:
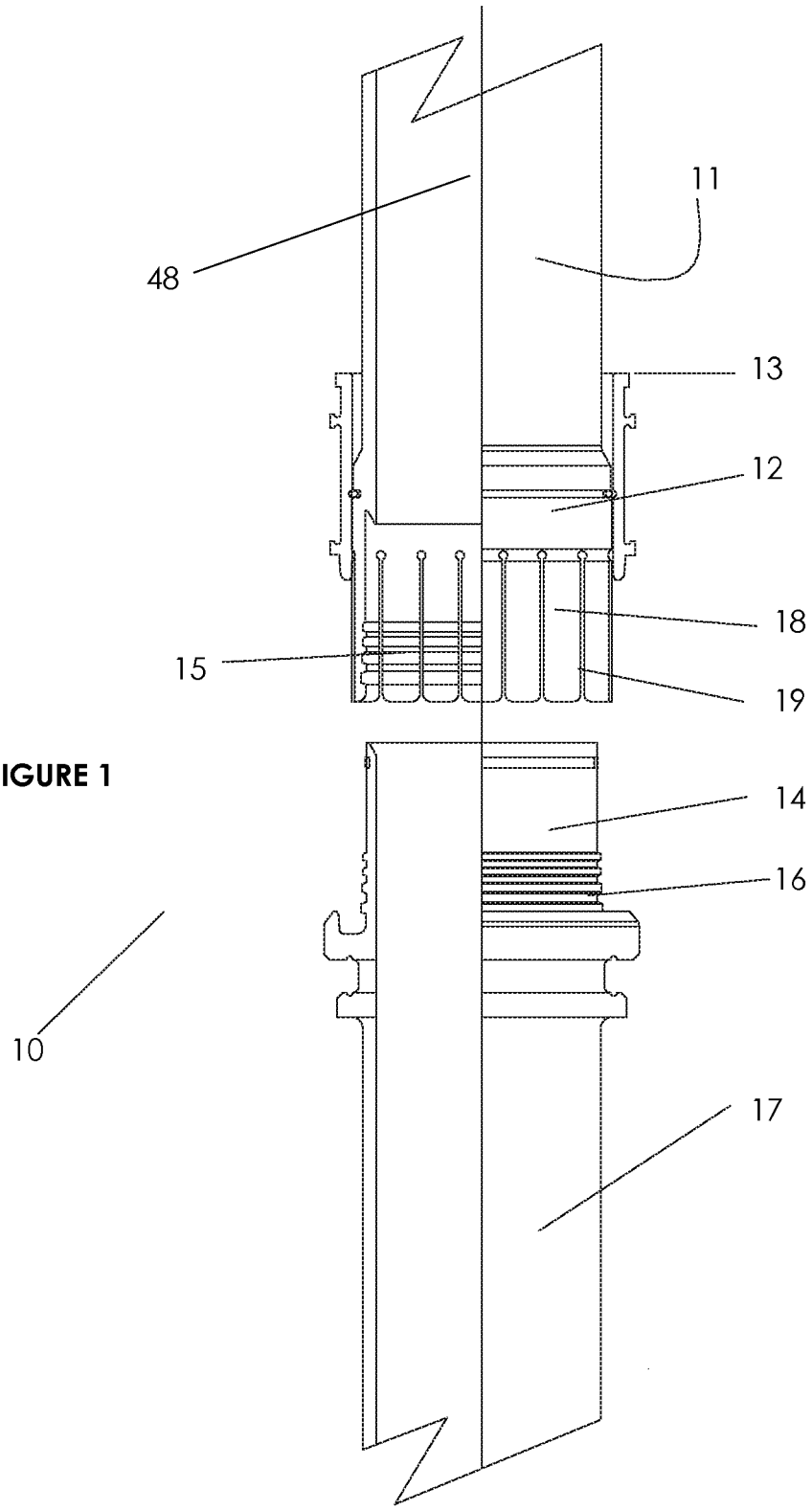
FIG. 1 depicts a portion of a disconnected heavy duty riser connector assembly with a permanent locking sliding sleeve.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relates to a marine riser connector. The embodiments further relate to a marine riser connector that is a simple, easy, push to makeup and push to lock together offshore riser connector, requiring no bolts, nor heavy flanges, requiring a simple hand held make up tool.

After lowering the upper riser joint onto a lower riser joint and pushing down an outer lock sleeve on the upper connector half, collets lock on the upper half into grooves on the lower connector half, keeping the riser connected and sealed at any depth in the location. The riser connector is capable of safely supporting any tensile and bending loads up to and equal to the capacity of the supporting vessel.

The marine riser connector is disassembled by simply pulling up on the locking sleeve with the same hand held tool that makes up the marine riser connector.

The marine riser connector's upper housing can have a plurality of evenly spaced cuts, known as saw cuts, positioned axially around the circumference of an internally grooved housing forming a flexible collet ring that when pushed in place, meshes with external groove of a lower connector housing. The connection is completed when the rigid outer lock ring, also known as a retaining ring, is forced down with the make up tool.

Offshore platforms are designed and built to provide a means to drill, explore and produce hydrocarbons in seawater.

Some of these operations are performed from jack-up rigs supported by rigid legs extending from the platform to the ocean floor in water depths of up to 500 feet or slightly more. These platforms are stable relative to ocean wave action but are limited to the water depth in which they can operate.

In deeper water, such as 3000 to 10,000 feet, drill ships, semisubmersibles, SPARS, or tension leg platforms are used with the majority of these operations taking place from drill ships and semisubmersibles. Regardless of which one is the rig of choice, all drilling and related operations are done through marine drilling risers which are made up of long joints of large diameter pipe forming even longer joints by the shorter lengths being welded together to form extended lengths up to 90 feet.

Each joint has bolt together flanges, lock dog or other type connectors welded to each end of the extended riser joint assemblies for connecting the joints together and forming a sealed riser system of the desired length depending on the water depth.

Flanges and brackets on the outer diameter of the typical riser joints support the choke and kill lines and the hydraulic booster lines which run along the outer diameter of the full length of the riser. When a riser is made up and run, a hydraulic connector is made up to the lower end of the first joint and as more joints are added at the surface rig, the connector get closer to the wellhead or blowout preventer on the ocean floor.

When the full length of the riser is made up and the hydraulic connector reaches the wellhead or blow out preventer, the connector is activated and the connector and riser are locked and sealed at the sea floor.

The riser is then connected to a riser tensioner on the supporting rig at the surface. The tensioner absorbs the kinetic forces generated by the yaw and heave of the rig caused by wave action and ocean currents that would normally be transferred into the riser and connectors and eventually cause damage or failure.

These embodiments relate in general to fast push to makeup and push to lock and seal marine riser joint connectors for the purpose of quickly constructing a working marine riser system extending from an ocean surface vessel to a wellhead or blowout preventer at the sea floor by connecting lengths of riser pipe together and sealing against both external and internal fluid and gas pressure and being capable of withstanding axial separation due to heavy tensile loading pressure form the pressure in the riser, the weight of the riser and its contents, all the while providing a safe work conduit from the rig at the surface to the borehole at the ocean floor.

In these embodiments, the riser connection is made up of three main sections, the upper housing collet section, welded to the lower end of a riser joint with the connector housing having grooves and ribs machined circumferentially in the lower inner diameter. A plurality of axial running saw cuts circumferentially are formed around a perimeter, running through the grooves and ribs, forming flexible collets which when being made up to the lower housing on the upper end of the next riser joint, slides over and ratchets down over matching grooves and ribs on the outer diameter of the lower section of the upper end of the next riser joint which is also welded to the upper end of the lower riser joint, snapping in place when the lowest most rib of the upper housing reaches the matching groove at the lower end of the plurality of circumferential grooves and ribs in the lower housing.

The sliding lock sleeve is run on the outer diameter of the upper grooved and ribbed collet housing so that after the upper housing is run down and ratcheted in place over the lower housing, the lock sleeve is pushed down over collets in the upper housing, locking the connector halves together and sealing the bore of the riser from the sea water. To unlock the connector halves, the sliding lock sleeve is pulled up from around the collets in the upper housing and the upper riser joint lifted up from the lower joint which will disengage the collets of the upper housing from the grooves and ribs in the lower housing.

In embodiments, the heavy duty riser connector assembly engages an upper riser joint. The heavy duty riser connector assembly can have an upper connector housing permanently attached to the upper riser joint.

A sliding lock sleeve is riding on the outer diameter of the upper connector and is there to slide down and lock the upper housing to the lower housing when male ribs of an upper connection housing fully engage grooves of the lower housing which is permanently attached to lower riser joint.

Vertical saw cuts can be around the circumference and cut through the groove and rib sections of the housing to form flexible collets.

In an embodiment, the upper riser joint and upper housing are lowered over a lower connector housing getting into position to be ratcheted over and into grooves of the lower housing.

In embodiments, the lowest rib of collets can be wider than all the grooves on the outer diameter of the lower housing except the last and lowest groove on the housing. This is so that the lowest rib of the flexible collet will bridge across all the other grooves while going down and across the grooves in the lower housing until the wider rib reaches the wider groove in the lower housing where they will mesh together. This allows all the other ribs and grooves to mesh together at the same time.

In embodiments, the upper housing of the upper riser is lowered over the lower housing of the lower riser joint and ribs of the flexible collet ratchet down to within one groove from the bottom end of the plurality of grooves in the lower connector housing.

When fully made up, the riser connector assembly with upper ribs of the upper housing fully engage with lower grooves of the lower housing and the retaining lock sleeve shifts down and locks into place by a retaining ring.

The riser connector assembly can be made up with choke and kill lines retained to the riser by bracket clamps. The choke and kill pipe sections can be held together by lock assemblies.

In an embodiment, the choke and kill lines and hydraulic booster lines can be supported by the riser connector assembly.

When the riser connector assembly is being either fastened together or disconnected, two hydraulic jacks can be used whereby lugs at the top and bottom of the jacks engage grooves in the sliding lock sleeve located on the outer diameter of the upper connector housing. A lower stationary groove located on the lower outer diameter of the lower connector housing can also be used. To make up the connector, the lower half of the connector is resting on a rigid support on the rig with the lower riser joint and the upper half lowered with an upper riser joint. The collet fingers of the connector with internal grooves ratchet over the external grooves of the lower connector.

When all the weight of the upper riser joint is relaxed, hydraulic jacks are placed at 180 degrees apart with the jacks lowering push pull lugs into place in the groove in the lower connector. Jacks position and upper push pull lug into a groove of the sliding lock sleeve on the upper connector.

Pulling the locking sleeve down over collet ribs and grooves provides a seal until at a later date, the jacks push the lock sleeve back up at which time the upper riser joint will be lifted thus pulling collet fingers from the grooves in the lower connector.

The embodiments provide a superior unique heavy duty marine riser connector designed for fast push to makeup and push again to lock in place and pull to unlock and pull again to break apart and separate.

In embodiments, the heavy duty riser connector assembly for joining together and sealing sections of riser pipe comprises an upper connector housing; a lower connector housing; grooves and ribs formed circumferentially on an outer diameter each housing.

The assembly can include a plurality of flexible collets to engage an opposite connector housing and a locking sliding sleeve to slide over and lock together the upper and lower connector housings.

Additionally a locking detent ring can be used and can be adapted to pop out and lock the permanent locking sliding sleeve in place so the permanent locking sliding sleeve is not effected by vibration when the permanent locking sliding sleeve has been slid over the plurality of flexible collets.

The assembly simultaneously can seal a riser bore against internal and external pressure simultaneously while additionally carrying heavy tensile and bending loads without deforming while engaging a riser for both drilling and production or any application requiring rapid makeup of pipe.

Turning now to the Figures, FIG. 1 shows a heavy duty riser connector assembly 10 for joining together and sealing sections of riser pipe with an upper connector housing 12 disconnected from a lower connector housing 14.

The heavy duty riser connector assembly 10 can have an upper connector housing 12 for engaging an upper riser joint 11 and a lower connector housing 14 for engaging a lower riser joint 17.

A longitudinal axis 48 can extend through the upper and lower connector housings.

A permanent locking sliding sleeve 13 can slide over the upper and lower connector housings to permanently lock together the upper and lower connector housings.

A plurality of upper housing grooves and ribs 15 can be formed circumferentially on an outer diameter of the upper connector housing.

A plurality of lower housing grooves and ribs 16 can be formed circumferentially on an outer diameter of the lower connector housing A plurality of flexible collets 19 can be formed on one of the connector housings, the plurality of flexible collets can have a plurality of saw cuts 18.

In embodiments, the plurality of flexible collects and the plurality of saw cuts can be parallel with to the longitudinal axis.

The plurality of upper and lower housing grooves and ribs, can also be referred to as lock grooves and ribs, and can be seen on the inner diameter and the plurality of saw cuts can be vertical and can be seen running across and through the area of the grooves and ribs, and the permanent locking sliding sleeve on the extreme outer diameter of the upper connector housing can be seen fully retracted.

Figure 2:
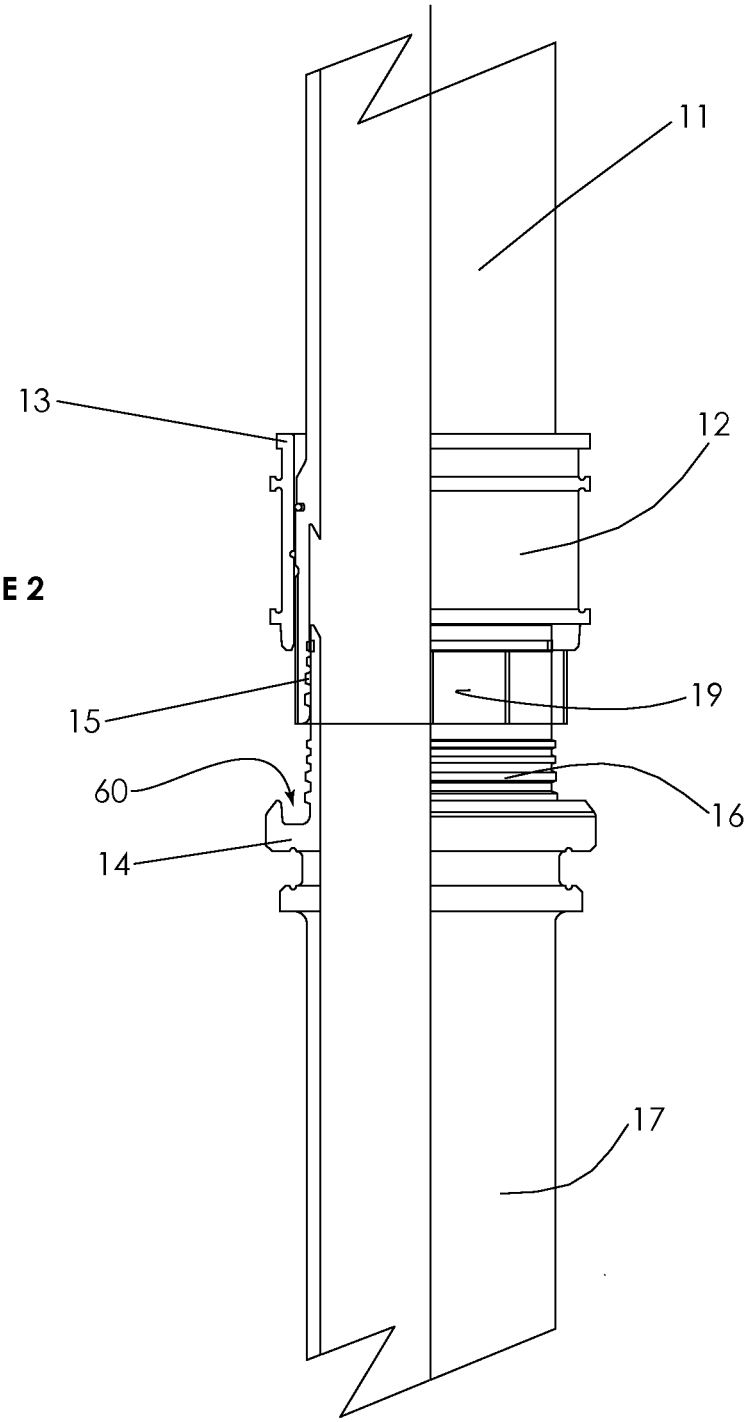
FIG. 2 depicts a portion of the heavy duty riser connector assembly with a permanent locking sliding sleeve.

FIG. 2 shows the upper riser joint 11 and the lower riser joint 17 connected by an engaged but not locked heavy duty riser connector assembly with the permanent locking sliding sleeve 13 positioned over a portion of the plurality of flexible collets 19 as the flexible collets partially engage the plurality of lower housing grooves and ribs 16.

Also shown in this Figure is the lower connector housing 14 as the permanent locking sliding sleeve is partially slid over the plurality of upper housing groove and ribs 15. A receiving groove 60 can be formed on the lower connector housing 14. The receiving groove 60 can be adapted to receive the permanent locking sliding sleeve 13. The receiving groove 60 constrains the movement of the permanent locking sliding sleeve 13 and holds the permanent locking sliding sleeve in place. The receiving groove and the locking detent ring 20 (shown in FIGS. 3 and 4) can act in conjunction to secure the permanent locking sliding sleeve 13 at both ends and create a structurally sound connection.

Figure 3:
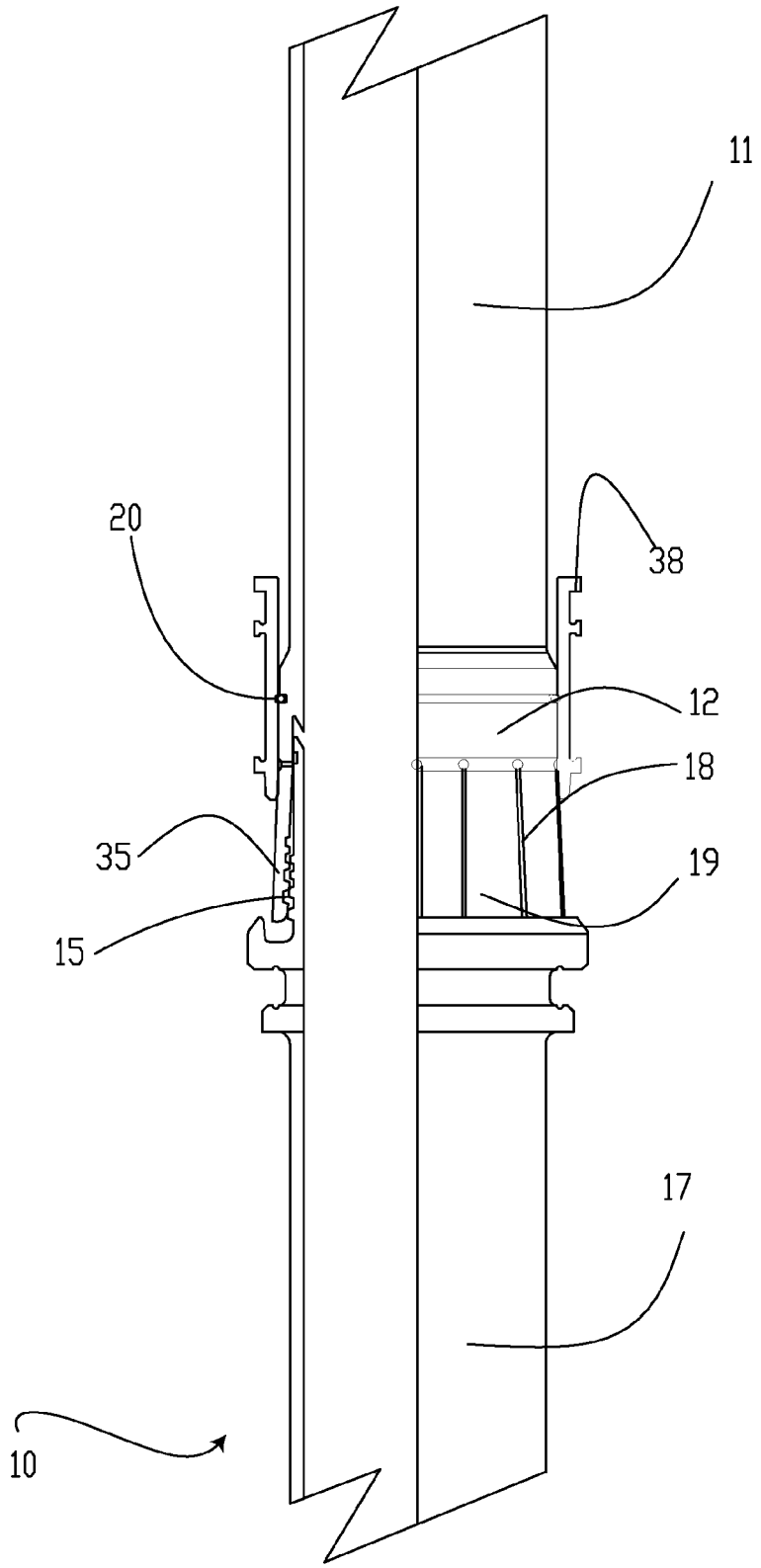
FIG. 3 depicts a partially unlocked view of the heavy duty riser connector assembly.

FIG. 3 shows the upper connector housing partially lowered over the lower connecting housing and the permanent locking sliding sleeve partially lowered over the plurality of collets of the permanent locking sliding sleeve.

The heavy duty riser connector assembly 10 shown with the upper connector housing 12 lowered over the lower connector housing with the male ribs of the plurality of upper housing groove and ribs 15 ratcheted down over the female grooves of the plurality of lower housing grooves and ribs housing but stopping short of the last and lowest grooves, which is the widest groove.

The upper riser joint 11 is shown with a locking and unlocking sliding sleeve 38 for sliding over both the upper and lower connector housings to removably lock together the upper and lower connector housings.

The upper connector housing 12 is shown moved towards the lower connector housing that engages the lower riser joint 17 with the plurality of flexible collets 19 over the lower connector housing with the plurality of saw cuts 18 allowing the plurality of flexible collets to move outwardly over the lower connector housing.

A removable key 35 can connect to the upper riser joint 11. The removable key can be configured to lock with plurality of grooves and ribs on each of the connector housings when the locking and unlocking sliding sleeve 38 engages over the removable key 35 and unlocks from the plurality of upper housing grooves and ribs 15 when the locking and unlocking sliding sleeve 38 is removed from the removable key.

A locking detent ring 20 is also shown and described in later Figures.

Figure 4:
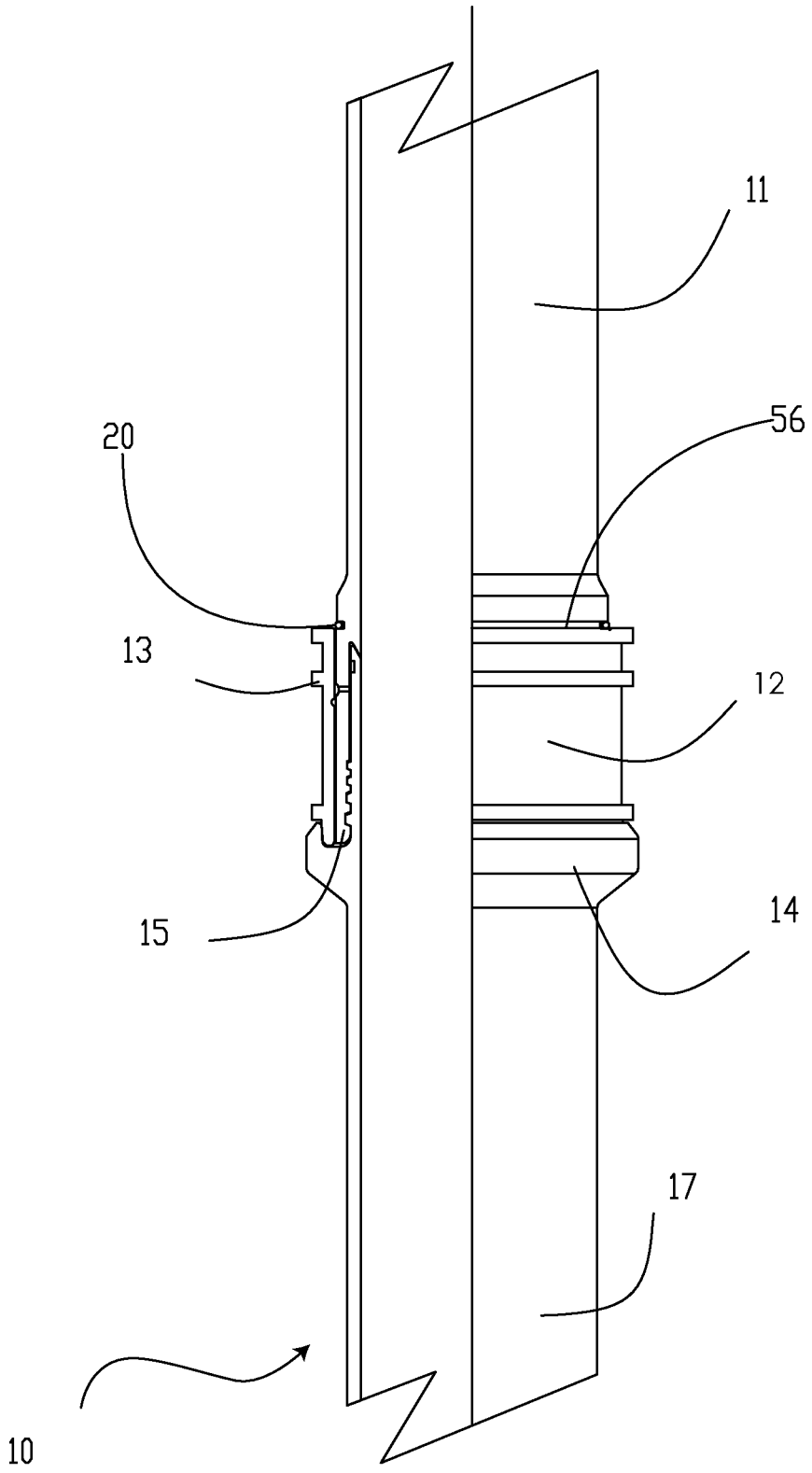
FIG. 4 depicts a locked and assembled heavy duty riser connector assembly.

FIG. 4 shows the heavy duty riser connector assembly 10 made up. The plurality of grooves and ribs in both connector housings are fully meshed and the locking detent ring 20 is shifted down to lock the upper and lower connector housings together.

The upper riser joint 11 is depicted with the permanent locking sliding sleeve 13 fully engaged over the lower connector housing 14 that in turn engages the lower riser joint 17.

The locking detent ring 20 is shown disposed in a circumferential ring groove 56 in the upper connector housing 12.

The locking detent ring 20 is adapted to pop out and lock the permanent locking sliding sleeve 13 in place so the permanent locking sliding sleeve is not affected by vibration when the permanent locking sliding sleeve 13 has been slid over the plurality of flexible collets.

The plurality of upper housing grooves and ribs 15 are shown fully engaged with the permanent locking sliding sleeve 13.

Figure 5:
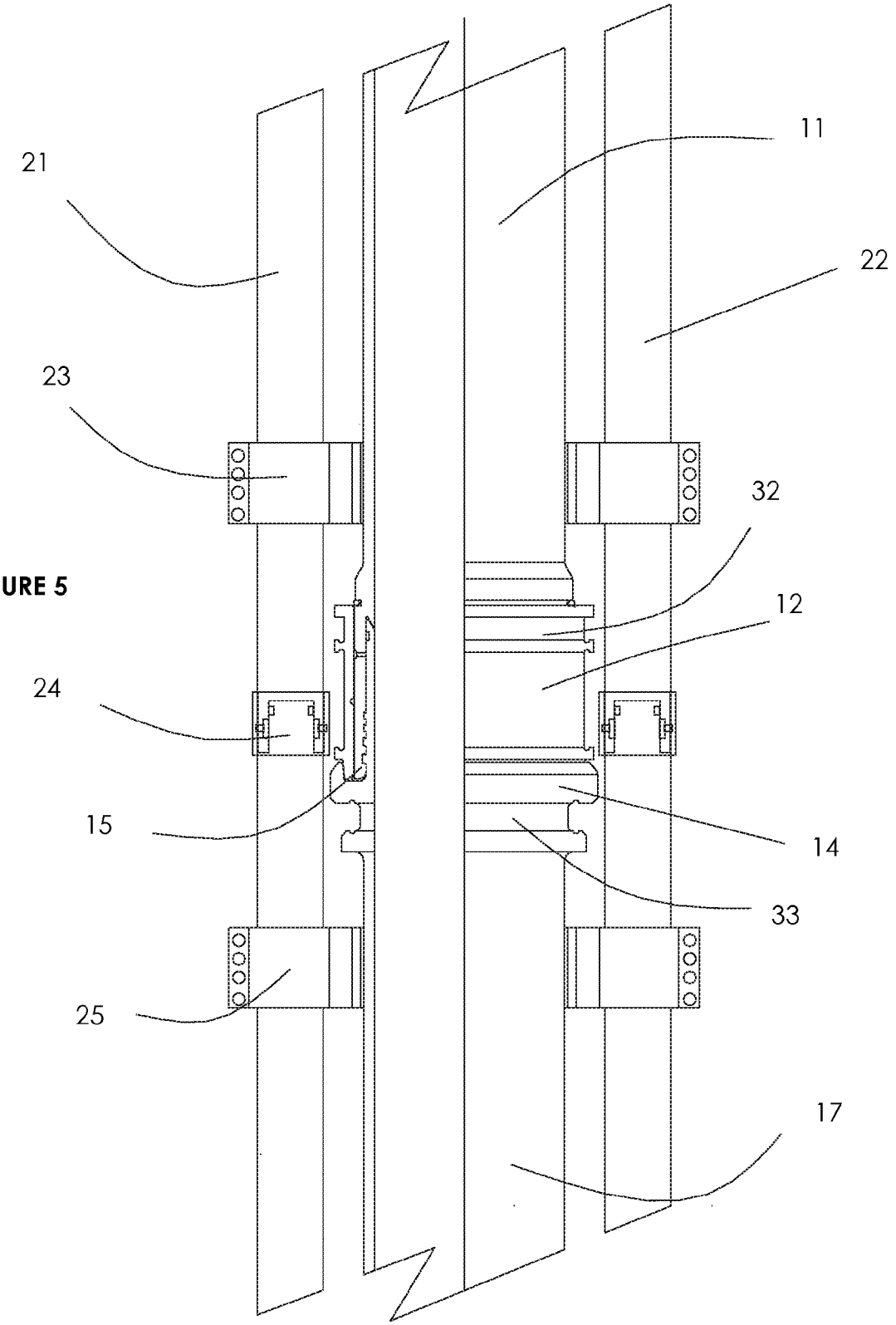
FIG. 5 depicts a permanent locking sliding sleeve with choke and kill lines.

FIG. 5 shows the heavy duty riser connector assembly completely made up and locked together with the choke and kill lines in place.

The upper riser joint 11 is depicted with a first bracket clamp 23.

The lower riser joint 17 is depicted with a second bracket clamp 25 extending therefrom.

The first bracket clamp 23 and the second bracket clamp 25 can support first choke and kill line 21 on one side of the heavy duty riser connector assembly and second choke and kill line 22 on an opposite side of the heavy duty riser connector assembly.

Details of the plurality of upper housing grooves and ribs 15 are viewable along with the upper connector housing 12 engaging the lower connector housing 14.

A first circumferential jack groove 32 is shown formed in the upper connector housing 12 and a second circumferential jack groove 33 is shown formed in the lower connector housing 14.

Figure 6:
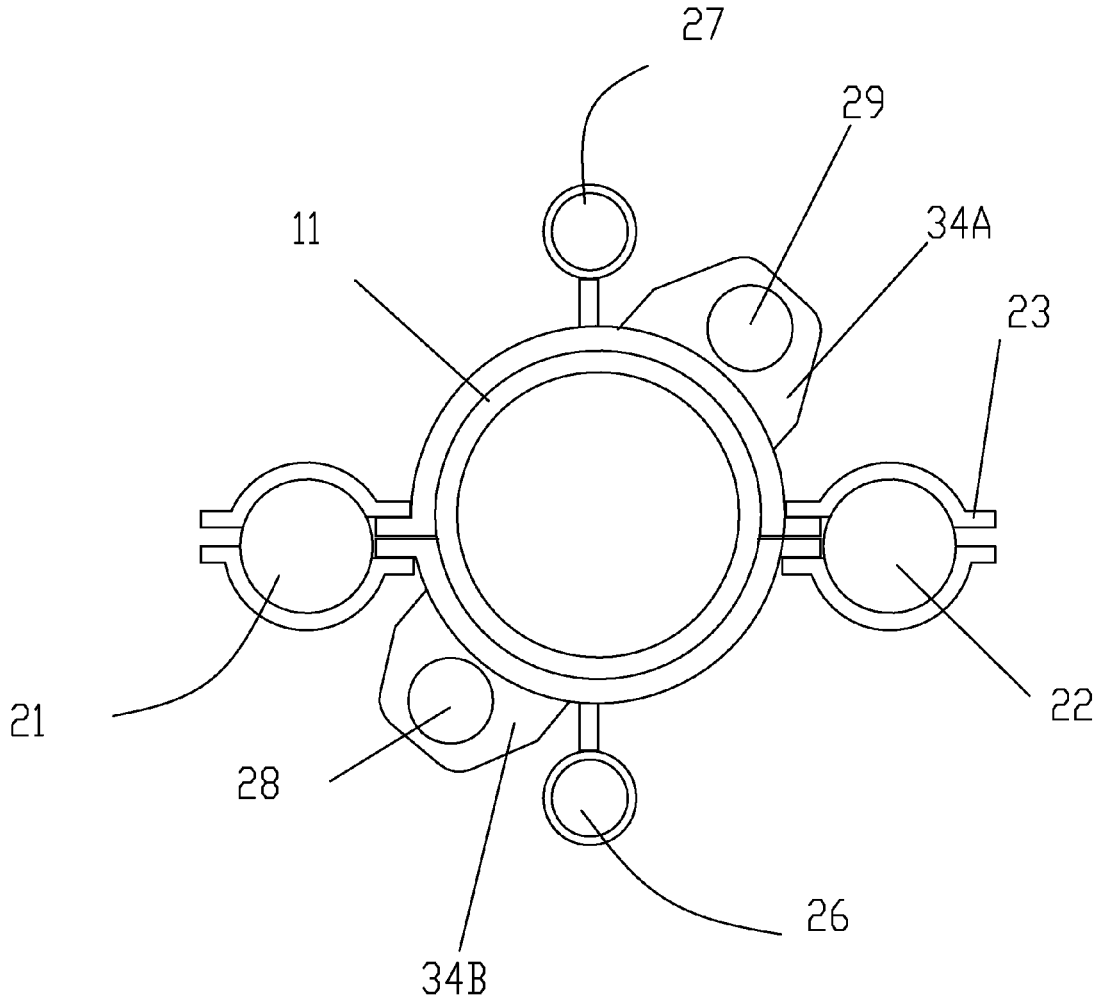
FIG. 6 depicts a cross section of a heavy duty riser connector assembly with choke and kill lines and hydraulic jacks.
Figure 7:
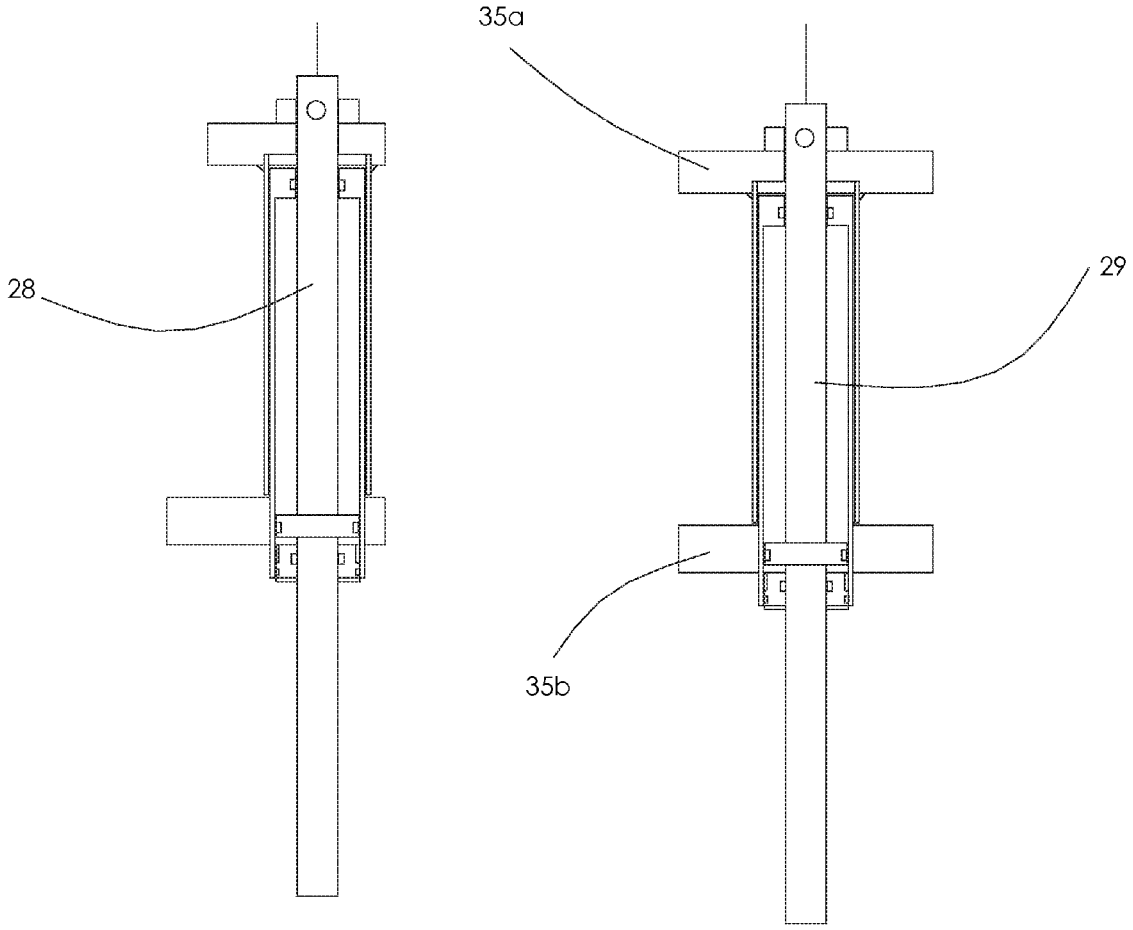
FIG. 7 shows the first hydraulic jack 28 and the second hydraulic jack 29 that shift the permanent locking sliding sleeve up and down.

The first circumferential jack groove and the second circumferential jack groove react against each other when the hydraulic jacks, shown in FIGS. 6 and 7 are pushing or pulling the permanent locking sliding sleeve over the plurality of flexible collets to permanently connect together the upper connector housing with the lower connector housing, wherein the circumferential jack grooves react against each other when the hydraulic jacks are pushing or pulling the permanent locking sliding sleeve over the plurality of flexible collet to permanently connect together the upper connector housing with the lower connector housing.

A lock assembly 24 for the first choke and kill line 21 can also be seen.

FIG. 6 depicts a cross section of a heavy duty riser connector assembly with choke and kill lines and hydraulic jacks.

A first hydraulic jack 28 and a second hydraulic jack 29 can be disposed around one of the riser joints, shown here as upper riser joint 10.

In embodiments, the hydraulic jacks can be an integrated one piece make up tool.

A plurality of push pull lugs, shown here as a first push pull lug 34*a* and a second push pull lug 34*b*, can be fit into either the first circumferential jack groove or the second circumferential jack groove or both.

The first bracket clamp 23 is also shown.

The first choke and kill line 21 is shown along with the second choke and kill line 22.

The heavy duty riser connector assembly can simultaneously (i) install a pair of choke and kill lines, shown as the first choke and kill lines 21 and the second choke and kill lines 22 and (ii) a pair of hydraulic booster lines, shown here as a first hydraulic booster line 26 and a second hydraulic booster line 27 on the upper connector housing while (iii) making up the heavy duty riser assembly.

The assembly seals a riser bore against internal and external pressure simultaneously while additionally carrying heavy tensile and bending loads without deforming while engaging a riser for both drilling and production or any other application requiring rapid makeup of pipe.

FIG. 7 shows the first hydraulic jack 28 and the second hydraulic jack 29 that shift the permanent locking sliding sleeve up and down. This Figure also depicts the first hydraulic jack, the second hydraulic jack, a lower push pull lug 35*b*, and an upper push pull lug 35*a*. The lower push pull lug 35*b* and the upper push pull lug 35*a* can engage the circumferential jack grooves. The first hydraulic jack 28 and the second hydraulic jack 29 can be disposed around one of the riser joints.

In embodiments, the upper connector housing stabs into the lower connector housing allowing the upper and lower connector housings to stab together, while the choke and kill lines are stabbed together and hydraulic booster lines are stabbed together establishing a three sealed fluid tight connection.

In embodiments, the flexible collect can have a bayonet latch configuration to stab and rotate to lock the permanent locking sliding sleeve to connect the upper and lower connector housings.

In embodiments, the upper connector housing and the lower connector housing can share the same longitudinal axis extending through the upper and lower connector housings.

In embodiments, the plurality of upper housing grooves and ribs can be formed circumferentially on an outer diameter of the upper connector housing with an upper mating groove.

In embodiments, the plurality of lower housing grooves and ribs can be formed circumferentially on an outer diameter of the lower connector housing with a lower mating groove.

In embodiments, the plurality of flexible collects can be formed on one of the connector housings. Each flexible collet can have a first rib, wherein the first rib can pass over a portion of the grooves and ribs of the connector housing to engage the mating groove of the opposite connector housing.

The first rib can be configured to be wider than all the housing grooves and ribs of the connector housing except the mating groove.

While these embodiments have been described with emphasis on the embodiments, it should be understood that within the scope of the appended claims, the embodiments might be practiced other than as specifically described herein.

What is claimed is:

1. A heavy duty riser connector assembly for joining together and sealing sections of riser pipe comprising:

a. an upper connector housing for engaging an upper riser joint;

b. a lower connector housing for engaging a lower riser joint and the upper connector housing;

c. a longitudinal axis extending through the upper and lower connector housings;

d. a plurality of upper housing grooves and ribs formed circumferentially on an outer diameter of the upper connector housing;

e. a plurality of lower housing grooves and ribs formed circumferentially on an outer diameter of the lower connector housing;

f. a plurality of flexible collets integrally formed as part of at least one of: the upper connector housing, the lower connector housing, or both, wherein each of the flexible collets of the plurality of flexible collets passes over a portion of the plurality of grooves and ribs of one of the upper connector housing and the lower connector housing to engage the other one of the upper connector housing and the lower connector housing;

g. a permanent locking sliding sleeve for sliding over both connector housings to permanently lock together the upper and lower connector housings;

h. a receiving groove formed on the lower connector housing adapted to receive the permanent locking sliding sleeve, wherein the receiving groove constrains the movement of the permanent locking sliding sleeve and holds the permanent locking sliding sleeve in place; and i. a locking detent ring adapted to pop out and lock the permanent locking sliding sleeve in place so the permanent locking sliding sleeve is not effected by vibration when the permanent locking sliding sleeve has been slid over the plurality of flexible collets; and wherein the heavy duty riser connector assembly simultaneously seals a riser bore against internal and external pressure while additionally carrying heavy tensile and bending loads without deforming and while engaging a riser for both drilling and production or any other application requiring rapid makeup of the pipe.

2. The heavy duty riser connector assembly of claim 1, wherein the plurality of flexible collets comprises a plurality of saw cuts formed in the connector housing parallel to the longitudinal axis.

3. The heavy duty riser connector assembly of claim 1, comprising:

a. a plurality of hydraulic jacks disposed around the upper riser joint, the lower riser joint, or both; and b. a plurality of push pull lugs, wherein at least one of the plurality of push pull lugs is configured to fit into a first circumferential jack groove formed in the upper connector housing, and a second circumferential jack groove formed in the lower connector housing, wherein each of the circumferential jack grooves react against each other when at least one of the hydraulic jacks are pushing or pulling the permanent locking sliding sleeve over the plurality of flexible collets to permanently connect together the upper connector housing with the lower connector housing.

4. The heavy duty riser connector assembly of claim 1, wherein the plurality of flexible collets are configured to stab in and rotate to lock the upper connector housing and the lower connector housing together without ratcheting.

5. The heavy duty riser connector assembly of claim 1, wherein the plurality of flexible collets have a bayonet latch configuration to stab and rotate to lock the permanent locking sliding sleeve to connect the upper connector housing and the lower connector housing.

6. The heavy duty riser connector assembly of claim 3, wherein the plurality of hydraulic jacks are an integrated one piece make up tool.

7. The heavy duty riser connector assembly of claim 1, wherein a pair of choke and kill lines and a pair of hydraulic booster lines are installed on the upper connector housing, the lower connector housing, or both while making up the heavy duty riser connector assembly.

8. The heavy duty riser connector assembly of claim 1, wherein the upper connector housing is configured to stab into the lower connector housing allowing the upper connector housing and the lower connector housing to stab together, while choke and kill lines are stabbed together and hydraulic booster lines are stabbed together establishing a three sealed fluid tight connection.

9. A heavy duty riser connector assembly for joining together and sealing sections of pipe comprising:

a. an upper connector housing for engaging an upper riser joint;

b. a lower connector housing for engaging a lower riser joint and the upper connector housing;

c. a longitudinal axis extending through the upper and lower connector housings;

d. a plurality of upper housing grooves and ribs formed circumferentially on an outer diameter of the upper connector housing;

e. a plurality of lower housing grooves and ribs formed circumferentially on an outer diameter of the lower connector housing;

f. at least one flexible collet integrally formed as part of at least one of: the upper connector housing, the lower connector housing, or both, wherein the at least one flexible collet passes over a portion of the plurality of grooves and ribs of one of the upper connector housing and the lower connector housing to engage the other one of the upper connector housing and the lower connector housing;

g. a locking and unlocking sliding sleeve for sliding over both connector housings to removably lock together the upper and lower connector housings;

h. a locking detent ring adapted to pop out and lock the locking and unlocking sliding sleeve in place so the locking and unlocking sliding sleeve is not effected by vibration when the locking and unlocking sliding sleeve has been slid over the at least one flexible collet;

i. a receiving groove formed on the lower connector housing adapted to receive the locking and unlocking sliding sleeve, wherein the receiving groove constrains the movement of the locking and unlocking sliding sleeve and holds the locking and unlocking sliding sleeve in place; and j. a removable key connected to the upper riser joint, the removable key configured to lock with the grooves and ribs on the connector housing when the locking and unlocking sliding sleeve engages over the removable key, and unlocks from the grooves and ribs when the locking and unlocking sliding sleeve is removed from the removable key; and wherein the heavy duty riser connector assembly simultaneously seals a riser bore against internal and external pressure while additionally carrying heavy tensile and bending loads without deforming and while engaging a riser for both drilling and production or any other application requiring rapid makeup of the pipe.

10. The heavy duty riser connector assembly of claim 9, wherein the at least one flexible collet comprises a plurality of saw cuts formed in the connector housing parallel to the longitudinal axis.

11. The heavy duty riser connector assembly of claim 9, comprising:

a. a plurality of hydraulic jacks disposed around one of the riser joints; and b. a plurality of push pull lugs, with one of the plurality of push pull lugs configured to fit into a circumferential jack groove formed in the upper connector housing, and a circumferential jack groove formed in the lower connector housing, wherein the circumferential jack grooves react against each other when the hydraulic jacks are pushing or pulling the locking and unlocking sliding sleeve over the at least one flexible collet to connect together the upper connector housing with the lower connector housing until the connector housings need to be disconnected.

12. The heavy duty riser connector assembly of claim 11, wherein the plurality of hydraulic jacks push the locking and unlocking sliding sleeve away from the locked position with the grooves and ribs causing a riser joint to lift, separating the at least one flexible collet from the grooves and ribs.

13. The heavy duty riser connector assembly of claim 9, wherein the at least one flexible collet is configured to stab in and rotate to lock the upper connector housing and the lower connector housing together without ratcheting.

14. The heavy duty riser connector assembly of claim 9, wherein the at least one flexible collet has a bayonet latch configuration to stab and rotate to lock the locking and unlocking sliding sleeve to connect the connector housings.

15. The heavy duty riser connector assembly of claim 11, wherein the plurality of hydraulic jacks are an integrated one piece make up tool.

16. The heavy duty riser connector assembly of claim 9, wherein the upper connector housing is configured to stab into the lower connector housing allowing the connector housings to stab together, while choke and kill lines are stabbed together and hydraulic lines are stabbed together establishing a three sealed fluid tight connection.

* * * * *